US006745813B2

(12) United States Patent
Yorgason

(10) Patent No.: US 6,745,813 B2
(45) Date of Patent: Jun. 8, 2004

(54) ROLLING PIVOT FOR TRACK SUSPENDED ARTICULATED PANELS

(76) Inventor: Kim Charles Yorgason, 151 Grulla Ct., Norco, CA (US) 92860

( * ) Notice: Subject to any disclaimer, the term of this patent is extended or adjusted under 35 U.S.C. 154(b) by 39 days.

(21) Appl. No.: 09/919,686

(22) Filed: Jul. 31, 2001

(65) Prior Publication Data

US 2002/0020507 A1 Feb. 21, 2002

Related U.S. Application Data

(60) Provisional application No. 60/221,819, filed on Jul. 31, 2000.

(51) Int. Cl.[7] ..... E05D 15/26

(52) U.S. Cl. ..... 160/199; 160/122; 160/196.1; 16/87 R

(58) Field of Search ..... 160/122, 199, 160/196.1, 223, DIG. 8; 16/87 R, 96 R; 49/229, 235; 187/324, 334

(56) References Cited

U.S. PATENT DOCUMENTS 3,708,916 A * 1/1973 Karp, Jr. et al. ..... 49/409
4,276,919 A 7/1981 Walters
4,476,652 A 10/1984 Beauchot
4,651,469 A 3/1987 Ngian et al.
4,852,628 A * 8/1989 Klein ..... 160/199
5,036,953 A * 8/1991 Munz ..... 187/56
5,090,171 A * 2/1992 Kano et al. ..... 52/243.1
5,406,676 A * 4/1995 Williams ..... 16/87 R
6,082,499 A 7/2000 O'Donnell
6,209,171 B1 * 4/2001 Pelletier et al. ..... 16/97

* cited by examiner

*Primary Examiner*—Bruce A. Lev
(74) *Attorney, Agent, or Firm*—Donn K. Harms

(57) ABSTRACT

An improved rolling pivot for suspended support of articulated panels such as shutters or room dividers in an overhead channel. The pivot features angled engagement of overlapped wheels of the rolling pivot in the overhead channel to thereby allow the supported articulated panels to be closed and opened by directing force to side edges of the suspended panels instead of having to pull the lead panel in the array. The pivot also allows for minimizing the width of the overhead channel and easy insertion and removal of individual pivot assemblies with the overhead channel by a simple rotation of the carriage of the pivot assembly to remove the wheels from operational engagement with tracks formed in the carriage and allow the wheels and pivot assembly to slide through a gap in the channel between the tracks.

20 Claims, 3 Drawing Sheets

21
3
30
12
29

3
3
20
22
14
30
3
18
26

28
22
31
20

23
23
30
32
18
26
28
6
12
29

30
6
22

29
22
31

22
6
28
23
23
28
27
30
30
32
18
26
32
18
26

ROLLING PIVOT FOR TRACK SUSPENDED ARTICULATED PANELS

FIELD OF THE INVENTION

This application claims the benefit of U.S. application Ser. No. 60/221,819 filed Jul. , 31, 2000.

This application the disclosed device relates to hanging articulated panels used for window shutters and room dividers and the like. More particularly it relates to a device to support the weight of one or a plurality of rotationally attached hanging panels such as shutters or room dividers in an overhead track and allow the hanging panels to translate or to fold into an accordion style configuration with panels adjacent to each other when the hanging panels are in a retracted position. Additionally the device provides the ability for insertion into the overhead track from any point along track as well as from the open ends.

BACKGROUND OF THE INVENTION

Conventional window shutters and large rectangular panels used to divide rooms and the like are generally comprised of rectangular hinged panels which hang in rotational engagement from overhead supports mounted in a track. In the case of window shutters the panels are sized to cooperatively engage with the window frames around a window opening. In the case of room divider panels used to separate a large room into smaller rooms for conventions and restaurants and similar venues, the hanging panels are also rectangular and sized to fit between the ceiling and floor of the venue to be subdivided.

Articulated panels whether used for window shutters, room dividers, French doors, or for other conventional purposes, generally feature an array of interconnected rectangular panels which are in a hinged engagement with an adjacent similarly dimensioned panel, along at least one vertical side edge when a pair of panels is suspendedly mounted in an overhead track. When more than two such hanging panels, all of the panels are suspended over the floor or other surface below the lower edge of the panels by a rotational engagement with a track engaged translating overhead support with all but the two end panels hinged on both vertical sides to adjacent similarly dimensioned hanging panels and with the two end panels hinged at one vertical side edge to an adjacent hanging panel.

Such hanging panels are conventionally supported by a rolling support assembly in rotational engagement with the top edge of each panel adjacent to both top corner edges of each panel. Typically the rolling support assembly has two wheels attached to axles engaging a carriage. The two wheels are cooperatively engaged inside the overhead track and roll therein as the supported hanging panels are moved from a compacted position to a fully extended position in line with each adjacent panel.

However such an array of interconnected articulated panels can be difficult to open and close when used in applications where the panels are vertically supported inside the overhead track or channel, especially where more than to panels are interconnected along their side edges as is the case with conventional articulated panels such as shutters and room dividers and the like. This difficultly is caused because conventionally available carriages and mechanisms used to support mid-array panel sections inside the overhead channel typically consist of carriages fitted with vertical wheels set parallel to the channel sidewalls. When a panel array formed of a plurality of suspended panels is fully retracted with the panels folded upon each other in a stacked engagement, the wheels of the typical carriage assembly engaged in the overhead channel are parallel to the channel center axis. While parallel engagement with the channel axis facilitates easy rolling when the panels are in an inline or extended position with each other, being parallel to the channel center axis with the array of panels in the retracted position, places the carriage wheels substantially perpendicular to the center axis of the top of the suspended panels and to the side edges of the hinged articulated panels. This makes it almost impossible to close the panel by pushing against the side edges of the panels because the pressure so exerted will not cause the wheels to turn since they are perpendicular to the pressure being exerted. Rather, the user must pull on the leading edge of the leading panel toward the closure point on the channel until the angle between a given pair of panels and the channel is sufficiently small to allow the pushing action on the side edges to be effective. As a consequence, conventional vertically supported panel arrays are either difficult and time consuming to operate, limited in the number of panels that can be joined in a panel assembly during use, or both.

Additionally, conventional carriage and wheel assemblies generally cooperatively engage by sliding the wheels into the channel from an open end or through cut out in one end of the channel. This makes maintenance a nuisance since changing a defective carriage requires its removal through an end point and insertion of a new one though the open end or gap at the end point.

As such, there is a continuing need for a rolling pivot for articulated panels in hinged engagement along their side edges which will allow for easy retraction and extension of a vertically suspended array of panels. Such a device should allow for the array of panels to be easily retracted to their stored or retracted position by minimal pressure on either the side edges of the hingedly engaged panels in the array or by pushing on the end panel. Further such a device should allow for the easy cooperative engagement of the carriage with the overhead channel from any point along the channels or through the openings at the end of the channel to facilitate maintenance of the array supports or changing of the panels so suspended by the channel.

SUMMARY OF THE INVENTION

The above problems, and others are overcome by the herein disclosed rolling pivot for articulated panels. As herein described the device alleviates the wheel angle to panel position problems inherent to conventional panels suspension components in retracted or extended panel arrays. The device provides this utility by setting the carriage wheels of the rolling pivot assembly engaged with the overhead channel, at an angle partway between the vertical and horizontal in relation to the vertical side edges of the hanging articulated panel. As a consequence, regardless of where force is applied to the suspended array of panels, whether it be on the side edges, the panel side surfaces, or by pulling on the side edge of the lead panel, the wheels will tend to move along in the desired direction until the panels reach their fully extended position substantially with their top edges substantially parallel to the center axis of the overhead channel.

This angled engagement of the carriage wheels in relation to the side edges and surface surfaces of the retracted panels in the array is provided in the construction of the rolling pivot assembly. Each pivot assembly is rotationally attached to an upper edge of a suspended panel adjacent to an upper corner of the suspended panel wherein each such suspended panel will be suspended by two such pivot assemblies. Each pivot assembly has a pivot bracket with a pair of wheel axles extending therefrom at angles to allow wheels engaged at the distal end of the axles to cooperatively engage in the channel in a tandem configuration at offsetting angles. The angle of the axles is generally between the being parallel the flat overhead surface mounting the channel being perpendicular to the side surfaces of the suspended panels of the array wherein force applied to the side surfaces, the side edges, or by pulling on the lead edge of the array will tend to move the panels along the channel in the desire direction.

The angled engagement of the axles with the pivot bracket and resulting offsetting angled engagement of the wheels with the channel provides an additional benefit. First, the width of the channel and the pivot assembly are greatly reduced from conventional arrangements thereby reducing the size for mounting and aesthetics and costs for manufacturing. Further, the wheels used have a determined diameter such that when mounted to the axles and turned sideways in the overhead channel, the pivot assemblies may be easily inserted into the channel through the gap at any point along the channels by simply rotating the pivot assembly until the wheels are out of engagement with the sides of the channels and pulling the pivot assembly out of the channel. This provides great utility for maintenance and replacement of the pivot assemblies as well as removal of panels and panel arrays without the need to disassemble them to slide them to an edge of the mounted channel. Still further, by overlapping the wheels in relation to the centerline of the carriage, the track width is minimized.

Accordingly, it is the object of this invention claimed herein to provide an improved rolling pivot for suspended articulated panel arrays which allows opening and closure of the array by applying force to any side or edge of the retracted array of panels.

It is another object of this invention to provide a rolling pivot which is insertable and retractable from its mounting channel at any point along the channel.

It is still another object of this invention to provide a rolling pivot for articulated panels which minimizes the width of the channel and pivot assemblies by providing angled engagement therebetween.

These and further objectives of this invention will be brought out in the following part of the specification, wherein detailed description is for the purpose of fully disclosing the invention without placing limitations thereon.

BRIEF DESCRIPTION OF THE DRAWING FIGURES

The accompanying drawings which are incorporated in and form a part of this specification illustrate embodiments of the disclosed device and together with the description, serve to explain the principles of the invention.

DETAILED DESCRIPTION OF THE PREFERRED EMBODIMENTS OF THE DISCLOSED DEVICE

Figure 1:
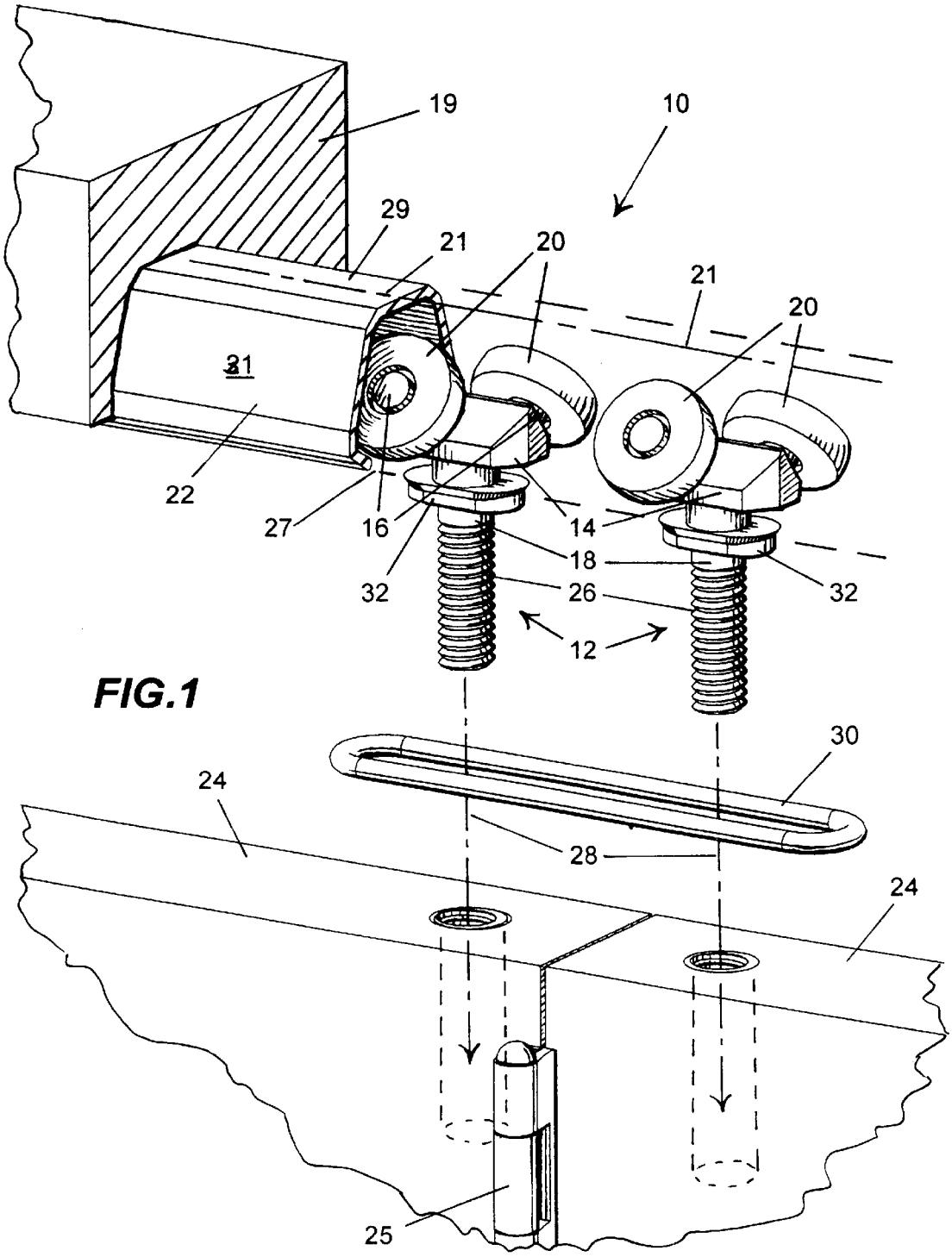
FIG. 1 depicts an exploded view of the pivot assembly engagement with the overhead channel and the suspended panels of an articulated panel array.

Referring now to the figures depicting the preferred embodiments of the disclosed device 10, FIG. 1 depicts an exploded view of the pivot assembly 12 which has a carriage 14 with a pair of axles 16 in angled engagement with the carriage 14 which is also attached to a support member 18 having a member center axis 28 therethrough. Wheels 20 are operatively mounted upon the axles 16.

The pivot assembly 12 cooperatively engages the channel 22 shown with the channel center axis 21, which is generally mounted to an overhead surface by attachment of the backwall 29 to the ceiling or similar overhead support 19 which is sufficient in weight bearing ability to suspend one or a plurality of door panels 24 making up the array of articulating door panels 24, such as shutters or room separators and the like, suspended from the overhead support 19.

Figures 2, 3, 4, 5, 6, 7:
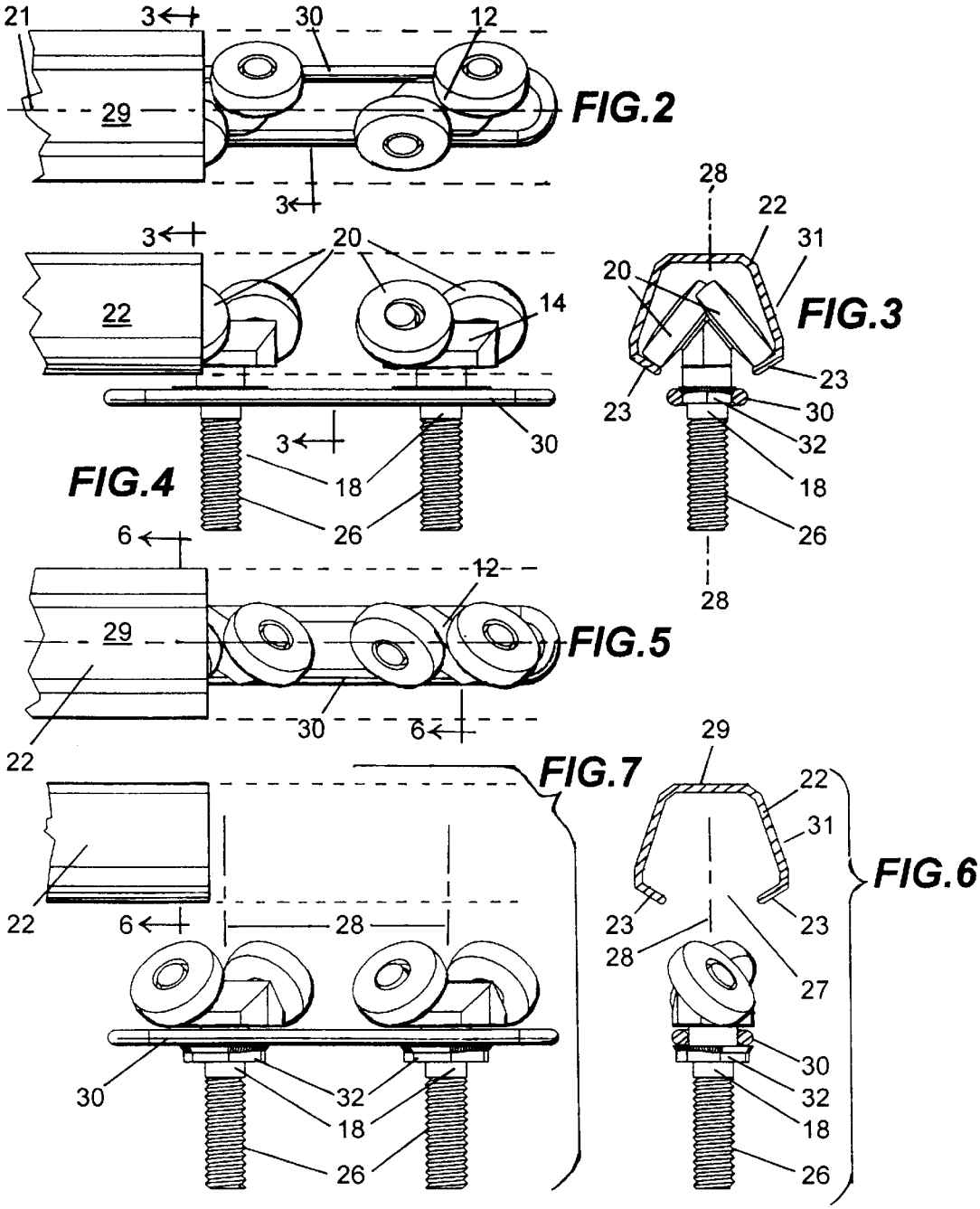
FIG. 2 shows a top view of the wheels of the pivot assembly and channel.
FIG. 3 depicts a sectional view through FIG. 2 showing the engagement of the wheels of the pivot assembly at offsetting angles within the channel with the aligning loop bracket engaging shoulder portions of the support member.
FIG. 4 is a side view of the pair of pivot assemblies of FIG. 2.
FIG. 5 is a top view of the wheels and pivot assembly rotated to a position where the pivot assembly may be removed from the channel through the gap in the channel.
FIG. 6 depicts a section view through FIG. 5 showing the rotated wheels insertable into the channel gap.
FIG. 7 depicts the pair of pivot assemblies of FIG. 5 showing the loop bracket for directional alignment in the disengaged position from the shoulder portions.
Figure 8:
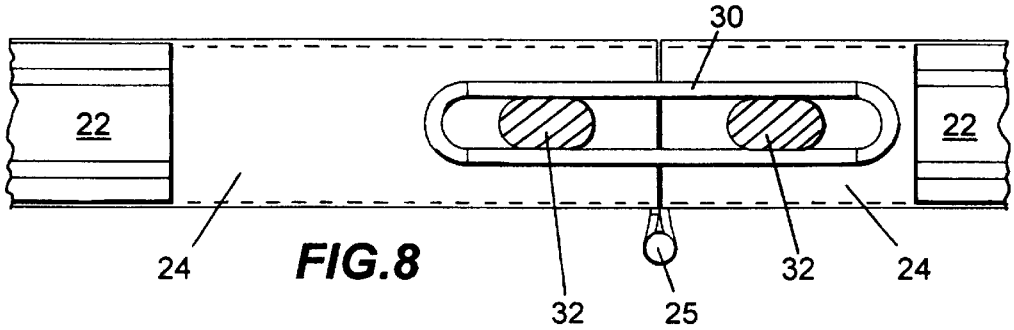
FIG. 8 is a top view showing the two panels in alignment with the channel and the two adjacent pivot assemblies also in alignment.

The pivot assembly 12 in the engaged position as shown in FIG. 3, with the channel 22 engaging the wheels 20 engaged in tracks 23 formed at the distal ends of the two sidewalls 31 the channel 22. The carriage 14 portion of the pivot assembly 12 is engaged at a first end of the support member 18 which extends downward through a gap 27 formed in the channel 22 between the sidewalls 31 and the two tracks 23, to a distal end 17 which is configured for operative rotational engagement the door panels 24 adjacent to the upper corners of the door panels 24. As depicted threads 26 engage similarly configured receiving threads in the door panels 24 to provide the operative rotational engagement therewith, however those skilled in the art could of course substitute other means for cooperative rotational engagement between the support member 18 and the door panels 24 and such is anticipated. The array of door panels 24 is conventionally interconnected by hinges 25 attaching adjacent side edges of adjacent door panels 24 with the two end door panels 24 having only one side edge connected to an adjacent door panel.

The wheels 20 as can be seen, rotate on the axles 16 which are at an angle in-between being perpendicular and parallel to the support member center axis 28 which also places the angle of the wheels 20 when engaged in the channel 22 at an angle between the vertically disposed side edges of the hanging articulated style door panels 24. Also, the angled placement of the axles 16 causes the wheels 20 to both slightly cross the member center axis 28 when rotationally mounted on the axles 16 so the axles 16 are mounted in offset positions on the carriage 14 to allow for this slight overlap of the wheels 20 with the member center axis 28. Placing the wheels 20 at such an angle provides a number of benefits to the device 10 in that the angled engagement of the axles 16 with the carriage 14 and resulting offsetting angled engagement of the wheels 20 in the tracks 23 of the channel 22 greatly reduce the needed with of both the channel 22 and the pivot assembly 12 thereby making the device 10 especially useful in areas where size is a concern such as window shutter support.

Figure 9:
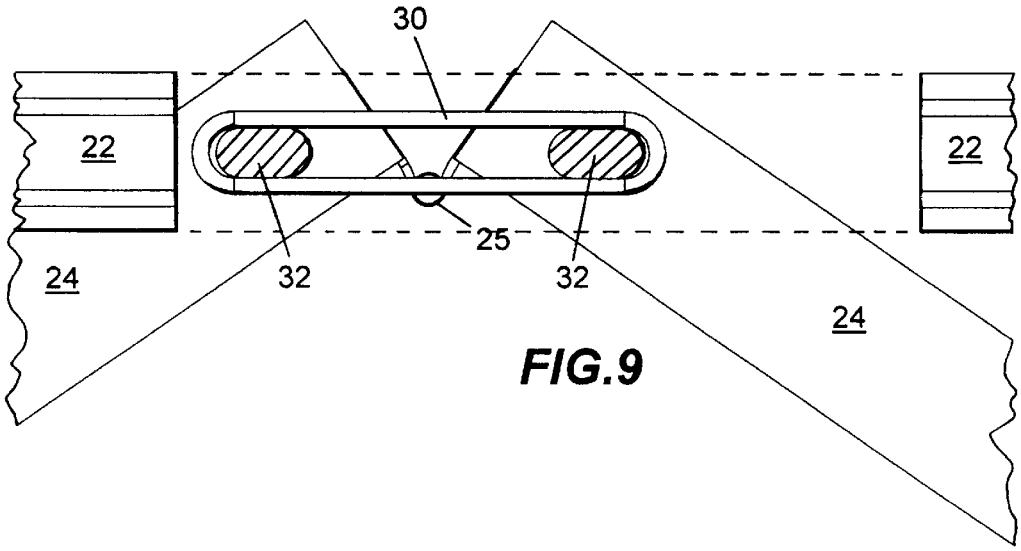
FIG. 9 depicts another top view of two suspended panels in a folded configuration and showing the adjacent pair of pivot assemblies in directional alignment.

As shown in FIG. 4 generally the door panels 24 being suspended by the pivot assemblies 12 will be in a hinged engagement with pivot assemblies 12 operatively engaged adjacent to both top corners of the door panels 24. A means for directional alignment of two adjacent pivot assemblies 12 attached to two adjacent door panels 24 having rotational engagement provided by the hinge 25 holding the two door panels 24 in rotational engagement, is provided by the loop bracket 30 which is removably engageable with a shoulder portion 32 located on the support member 18. The loop bracket 30 is dimensioned for frictional engagement with the shoulder portion 32 such that it may be snapped over the shoulder portion 32 which is positioned on the exterior of the support member 18 such that the shoulder portion 32 is just above the top surface of the door panel 24 when the support member 18 is operatively engaged with the door panel 24. With the loop bracket 30 in this engaged position, the suspended door panels 24 forming an array of panels may be opened or closed easily by pushing on the sides of the two door panels 24 along the edge of their hinged engagement when both panels 24 are in a bent alignment with each other as depicted in FIG. 9. Of course other means for directional alignment of two adjacent pivot assemblies 12 might be used by those skilled in the art and such is anticipated, however the current best mode features the engagement of the loop bracket 30 on shoulder portions 32 of adjacent pivot assemblies 12.

Additionally, in the current best embodiment, the wheels 20 have a diameter slightly less than the diameter of the gap 27 in the overhead mounted channel 22. As depicted in FIGS. 5–7 this is especially important function as pivot assembly 12 may be easily inserted into, and removed from, the channel 22 through the gap 27 at any point along the channel 22 by simply rotating the pivot assembly 12 until the wheels 20 are out of engagement with the tracks 23 of the channel 22. The pivot assembly 12 can then be easily removed from the channel 22 through the gap 27. Replacement of a pivot assembly 12 is done in the reverse fashion.

While all of the fundamental characteristics and features of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. A pivot mechanism for supporting articulated panels comprising:

an elongated channel having a channel center axis, a rear wall, and a pair of sidewalls extending from said rear wall, said sidewalls having a gap therebetween;

a first track formed in one of said pair of sidewalls and a second track formed in the other of said pair of sidewalls;

a pivot assembly having a carriage portion, said carriage portion having a carriage center axis running therethrough;

a support member extending from said carriage portion said support member having a support center axis therethrough;

a first axle and a second axle both extending at fixed substantially opposite angles from an offset attachment of said first and second axles to said carriage;

a first wheel having a first circumference and a second wheel having a second circumference, both rotationally attached to said first axle and said second axle respectively;

said first circumference and said second circumference overlapping said carriage center axis;

said pivot assembly engageable with said channel with said first wheel rollingly engageable with said first track and said second wheel rollingly engageable with said second track thereby slidingly engaging said pivot assembly with said channel; and means for cooperative rotational engagement between the support member and the top of said articulated panel to be suspended by said pivot assembly when said pivot assembly is slidably engaged with said channel.

2. The pivot mechanism for supporting articulated panels as defined in claim 1 further comprising:

said pivot assembly having an engaged position with said first and second wheel cooperatively engaged engaging said first and said second track respectively;

said pivot assembly having a disengaged position with said first and said second wheel out of engagement with said first and said second track respectively;

said pivot assembly rotatable to said disengaged position while said door panel is being suspended by said pivot assembly, by rotating said carriage to a position wherein said carriage center axis is substantially normal to said channel center axis; and said circumference of said first wheel and said circumference of said second wheel both being dimensioned to allow said first wheel and said second wheel to traverse through said gap when said pivot assembly is in said disengaged position.

3. The pivot mechanism for supporting articulated panels as defined in claim 2 further wherein said means for cooperative rotational engagement between the support member and the top of a door panel comprises:

threads on the exterior of the distal end of said support member cooperatively engageable with threads attached to the top of said door panel.

4. The pivot mechanism for supporting articulated panels as defined in claim 2 further comprising:

a plurality of said pivot assemblies adapted to be attached in pairs to a plurality of door panels in hinged engagement to each other along at least one door side edge;

each of said door panels having one of said pair of pivot assemblies attached at a top edge adjacent to one top corner and a second pivot assembly of said pair of pivot assemblies attached at a top edge adjacent to the opposite corner of said door panel; and means for maintaining alignment of said carriage center axis of two adjacent pivot assemblies when each is attached at and adjacent corner of two adjacent door panels of said plurality of door panels, whereby each of said plurality of door panels is supported by a pair of said pivot assemblies and the pivot assemblies attached adjacent to each other to different door panels are maintained with their respective carriage axis in alignment when moving in said channel.

5. The pivot mechanism for supporting articulated panels as defined in claim 4 further comprising:

said means for maintaining alignment of said carriage center axis of two adjacent pivot assemblies comprises:

a loop bracket, said loop bracket having an interior aperture; and said interior aperture sized to frictionally engage a shoulder portion located on the exterior of each support member.

6. The pivot mechanism for supporting articulated panels as defined in claim 4 wherein said plurality of door panels are window shutters engaged by hinges along side edges of said shutters.

7. The pivot mechanism for supporting articulated panels as defined in claim 3 further comprising:

a plurality of said pivot assemblies adapted to be attached in pairs to a plurality of door panels in hinged engagement to each other along at least one door side edge;

each of said door panels having one of said pair of pivot assemblies attached at a top edge adjacent to one top corner and a second pivot assembly of said pair of pivot assemblies attached at a top edge adjacent to the opposite corner of said door panel; and means for maintaining alignment of said carriage center axis of two adjacent pivot assemblies when each is attached at and adjacent corner of two adjacent door panels of said plurality of door panels, whereby each of said plurality of door panels is supported by a pair of said pivot assemblies and the pivot assemblies attached adjacent to each other to different door panels are maintained with their respective carriage axis in alignment when moving in said channel.

8. The pivot mechanism for supporting articulated panels as defined in claim 3 further comprising:

said means for maintaining alignment of said carriage center axis of two adjacent pivot assemblies comprises:

a loop bracket, said loop bracket having an interior aperture; and said interior aperture sized to frictionally engage a shoulder portion located on the exterior of each support member.

9. The pivot mechanism for supporting articulated panels as defined in claim 3 wherein said plurality of door panels are window shutters engaged by hinges along side edges of said shutters.

10. The pivot mechanism for supporting articulated panels as defined in claim 1 further wherein said means for cooperative rotational engagement between the support member and the top of a door panel comprises:

threads on the exterior of the distal end of said support member cooperatively engageable with threads attached to the top of said door panel.

11. The pivot me for supporting articulated panels as defined in claim 10 further comprising:

a plurality of said pivot assemblies adapted to be attached in pairs to a plurality of door panels in hinged engagement to each other along at least one door side edge;

each of said door panels having one of said pair of pivot assemblies attached at a top edge adjacent to one top corner and a second pivot assembly of said pair of pivot assemblies attached at a top edge adjacent to the opposite corner of said door panel; and means for maintaining alignment of said carriage center axis of two adjacent pivot assemblies when each is attached at and adjacent corner of two adjacent door panels of said plurality of door panels, whereby each of said plurality of door panels is supported by a pair of said pivot assemblies and the pivot assemblies attached adjacent to each other to different door panels are maintained with their respective carriage axis in alignment when moving in said channel.

12. The pivot mechanism for supporting articulated panels as defined in claim 10 further comprising:

said means for maintaining alignment of said carriage center axis of two adjacent pivot assemblies comprises:

a loop bracket, said loop bracket having an interior aperture; and said interior aperture sized to frictionally engage a shoulder portion located on the exterior of each support member.

13. The pivot mechanism for supporting articulated panels as defined in claim 10 wherein said plurality of door panels are window shutters engaged by hinges along side edges of said shutters.

14. The pivot mechanism for supporting articulated panels as defined in claim 1 further comprising:

a plurality of said pivot assemblies adapted to be attached in pairs to a plurality of door panels in hinged engagement to each other along at least one door side edge;

each of said door panels having one of said pair of pivot assemblies attached at a top edge adjacent to one top corner and a second pivot assembly of said pair of pivot assemblies attached at a top edge adjacent to the opposite corner of said door panel; and means for maintaining alignment of said carriage center axis of two adjacent pivot assemblies when each is attached at and adjacent corner of two adjacent door panels of said plurality of door panels, whereby each of said plurality of door panels is supported by a pair of said pivot assemblies and the pivot assemblies attached adjacent to each other to different door panels are maintained with their respective carriage axis in alignment when moving in said channel.

15. The pivot mechanism for supporting articulated panels as defined in claim 14 further comprising:

said means for maintaining alignment of said carriage center axis of two adjacent pivot assemblies comprises:

a loop bracket, said loop bracket having an interior aperture; and said interior aperture sized to frictionally engage a shoulder portion located on the exterior of each support member.

16. The pivot mechanism for supporting articulated panels as defined in claim 14 wherein said plurality of door panels are window shutters engaged by hinges along side edges of said shutters.

17. A mechanism for supporting articulated panels comprising:

an elongated channel having a channel center axis, a rear wall, and a pair of sidewalls extending from said rear wall, said sidewalls having a gap therebetween;

a first track formed in one of said pair of sidewalls and a second track formed in the other of said pair of sidewalls;

a pivot assembly having a carriage portion, said carriage portion having a carriage center axis running therethrough;

a support member extending from said carriage portion said support member having a support center axis therethrough;

a first axle and a second axle both extending at fixed substantially opposite angles from an offset attachment of said first and second axles to said carriage, a first wheel having a first circumference and a second wheel having a second circumference, both rotationally attached to said first axle and said second axle respectively;

said first circumference and said second circumference overlapping said carriage center axis;

said pivot assembly engageable with said channel with said first wheel rollingly engageable with said first track and said second wheel rollingly engageable with said second track thereby slidingly engaging said pivot assembly with said channel; and means for cooperative rotational engagement between the support member and the top of a door panel to be suspended by said pivot assembly when said pivot assembly is slidably engaged with said channel.

18. The pivot mechanism for supporting articulated panels as defined in claim 17 further comprising:

said pivot assembly having an engaged position with said first and second wheel cooperatively engaged engaging said first and said second track respectively;

said pivot assembly having a disengaged position with said first and said second wheel out of engagement with said first and said second track respectively;

said pivot assembly rotatable to said disengaged position while said door panel is being suspended by said pivot assembly, by rotating said carriage to a position wherein said carriage center axis is substantially normal to said channel center axis; and said circumference of said first wheel and said circumference of said second wheel both being dimensioned to allow said first wheel and said second wheel to traverse through said gap when said pivot assembly is in said disengaged position.

19. The pivot mechanism for supporting articulated panels as defined in claim 12 further wherein said means for cooperative rotational engagement between the support member and the top of a door panel comprises:

threads on the exterior of the distal end of said support member cooperatively engageable with threads attached to the top of said door panel.

20. The pivot mechanism for supporting articulated panels as defined in claim 17, further comprising:

a plurality of said pivot assemblies adapted to be attached in pairs to a plurality of door panels in hinged engagement to each other along at least one door side edge;

each of said door panels having one of said pair of pivot assemblies attached at a top edge adjacent to one top corner and a second pivot assembly of said pair of pivot assemblies attached at a top edge adjacent to the opposite corner of said door panel; and means for maintaining alignment of said carriage center axis of two adjacent pivot assemblies when each is attached at and adjacent corner of two adjacent door panels of said plurality of door panels, whereby each of said plurality of door panels is supported by a pair of said pivot assemblies and the pivot assemblies attached adjacent to each other to different door panels are maintained with their respective carriage axis in alignment when moving in said channel.

* * * * *